US005613650A

United States Patent [19]

Kaifu et al.

[11] Patent Number: 5,613,650

[45] Date of Patent: Mar. 25, 1997

[54] GUIDED MISSILE

[75] Inventors: Masao Kaifu, Yokohama; Sadao Tsubokura, Kamakura, both of Japan

[73] Assignee: Kabushiki Kaisha Toshiba, Kawasaki, Japan

[21] Appl. No.: 527,580

[22] Filed: Sep. 13, 1995

[51] Int. Cl.[6] ..... F42B 15/01; F41G 7/20

[52] U.S. Cl. ..... 244/3.16; 102/211; 244/3.15; 244/3.19

[58] Field of Search ..... 244/3.15, 3.16, 244/3.19, 3.2, 3.21; 102/211; 342/68

[56] References Cited

FOREIGN PATENT DOCUMENTS

| | | |
|---|---|---|
| 2388468 | 11/1978 | France . |
| 2661252 | 10/1991 | France . |
| 4-13100 | 1/1992 | Japan . |
| 4-254199 | 9/1992 | Japan . |

*Primary Examiner*—Michael J. Carone
*Assistant Examiner*—Theresa M. Wesson
*Attorney, Agent, or Firm*—Oblon, Spivak, McClelland, Maier & Neustadt, P.C.

[57] ABSTRACT

In a guided missile, a target direction detecting unit finds, from target information obtained at a target acquisition unit, a direction of the target in terms of a roll-, a pitch- and a yaw-axis of a missile fuselage, rotation amount computing units computer amounts of rotation around the roll-, pitch- and yaw-axis to allow the missile fuselage to be directed at a predictive missile/target point, and steering control units impart the amounts of rotation to the missile fuselage. Antennas for a proximity fuse are arranged around a circumferential surface side of the missile fuselage and radiate beams in mutually different directions with at least one of these antennas radiating a different beam at a forward-tilt angle other than the remaining ones. A beam forward-tilt angle selecting unit selects a proper forward-tilt angle beam from flight information of the missile and target. The fuselage is controlled based on a result of computation around the roll-axis to allow the selected beam to be oriented toward the direction of the target. It is, therefore, possible to provide a compact guided missile which can select a beam forward-tilt angle in a simple procedure in accordance with the velocity of the target and exert a warhead detonation effect on a missile target having various speed ranges.

5 Claims, 4 Drawing Sheets

GUIDED MISSILE

BACKGROUND OF THE INVENTION

1. Field of the Invention

The present invention relates to a proximity fuse-mounted guided missile, for example, an air missile such as an SAM (surface-to-air missile) and AAM (air-to-air missile), and to a system for controlling the radiation direction of a beam (light wave or electromagnetic wave).

2. Description of the Related Art

Usually, the air missile is equipped with a proximity fuse and designed to radiate a beam (light wave or electromagnetic wave) from the proximity fuse antennas, detect a target from an echo and detonate a missile warhead and hence destroy the target. The effective beam range is set in an effective radius of the missile warhead.

Generally, the antenna of the missile's proximity fuse radiates a target detection beam B from just beside the missile M as shown in FIG. 1A. Here, even when the target T enters within an effective range of the beam B, the proximity fuse involves a time delay until it is detonated. In the case of the target T being an airplane, the target is larger than the missile M and relatively slower in speed and, as shown in FIG. 1B, the detonation timing of the missile warhead is not appreciably important, taking its delay into consideration, and the target can be destroyed.

In the case of the target T being a high-speed missile and hence being smaller in size and greater in flight speed, even if the target T enters within a detection beam B of the proximity fuse antenna in the case where the target detection beam B is radiated from alongside the fuselage, the target T passes the effective range of the missile before the detonation of the proximal fuse, thus failing to destroy the target T.

In the prior art, it may be considered that, through the forward tilting of the beam B as shown in FIG. 3A, proper timing is taken from the detection of the target T until the explosion of it so that the target T can be destroyed. According to this system, no proper detonation timing is taken as shown in FIG. 3D for the case of the target being a low-speed missile (small in size and small in flight speed), so that the target cannot be destroyed.

In the air missile designed to destroy an opponent missile as the target, the most effective method is by considering the beam's forward tilt angle in accordance with the speed of the target. Taking the mount space of the proximity fuse into consideration it is very difficult to freely vary the beam's forward tilt angle from a practical point of hardware.

SUMMARY OF THE INVENTION

It has been conventionally desired that, as set out above, the antenna beams' forward-tilt angles at the proximity fuse be freely made variable in accordance with the speed of the target. However, it has been difficult to attain the above object of the present invention because of a limited mount space involved from a practical viewpoint of design. For this reason, the beams' forward-tilt angles have been determined unconditionally, thus failing to destroy a target flying at a speed not properly followed by the missile.

It is accordingly the object of the present invention to provide a compact missile which can select antenna beams' forward-tilt angles in a simple procedure in accordance with the speed of a target can exert a warhead detonation effect on a missile target of various speed ranges.

According to the present invention, there is provided a guided missile comprising: a target acquisition unit for acquiring a target and obtaining target information; a target direction detecting unit for detecting, from the target information obtained at the target acquisition unit, the direction of the target in terms of a roll-, a pitch- and a yaw-axis of a missile fuselage; rotation amount computing units for computing amounts of rotation around the roll-, pitch-, and yaw-axis of the missile to allow the missile to be directed at the target detected by the target direction detecting unit; steering control units for imparting the rotation amount around the roll-, pitch- and yaw-axis of the missile obtained by the rotation amount computing unit to the missile fuselage; a plurality of antennas for a proximity fuse which are arranged at a corresponding number of places around a circumferential surface side of the fuselage and radiating target detection beams in mutually different directions with at least one of these antennas radiating a beam at a predetermined forward-tilt angle; a beam selecting unit for obtaining the flight information of the missile and target and selecting a beam of a proper angle on the basis of a result of obtained flight information; and roll rotation amount compensating means for compensating for a result of computation by the rotation amount computing units regarding the roll-axis rotation to allow a detonating direction of the missile to be oriented at the target when the target is acquired with the beam selected by the beam selecting unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Before detailed explanation of one embodiment according to the present invention, an explanation will be given of the principle on which it is operated.

Figure 1A:
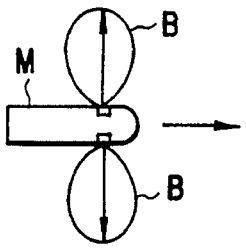
FIG. 1A is a concept diagram showing a relation, to a detonation timing, of antenna beam orientation direction of a proximity fuse mounted on a conventional an anti-aircraft missile.
Figure 1B:
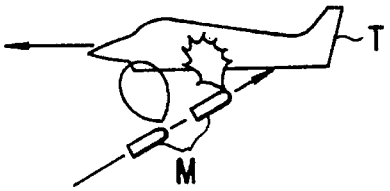
FIG. 1B is a view associated with FIG. 1A.
Figure 2A:
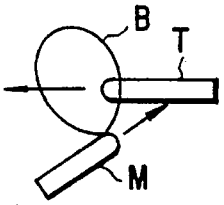
FIG. 2A is a concept diagram for explaining a relative relation associated with a high-speed target missile at which the missile of FIG. 1A is directed.
Figure 2B:
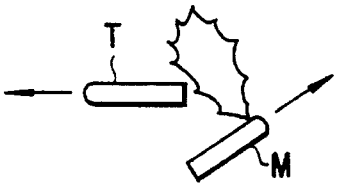
FIG. 2B is a view associated with FIG. 2A.
Figure 3A:
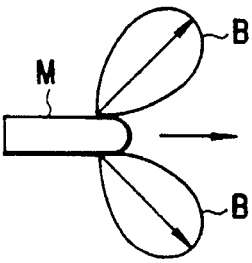
FIG. 3A is a concept diagram showing a relation, to a detonation timing, of an antenna beam orientation direction of a proximity fuse mounted on a conventional anti-missile missile.
Figure 3B:
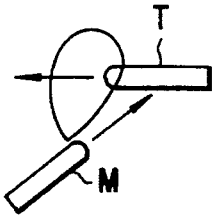
FIG. 3B is a view associated with FIG. 3A.
Figure 3C:
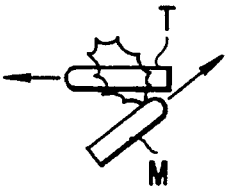
FIG. 3C is a view associated with FIG. 3A.
Figure 3D:
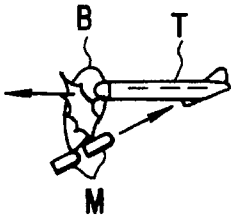
FIG. 3D is a view associated with FIG. 3A.
Figure 4A:
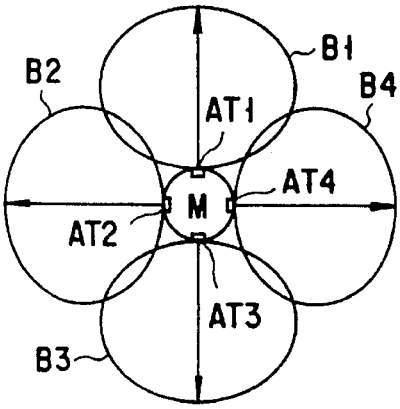
FIG. 4A is a concept diagram showing one example of a beam pattern with respect to the positions of antennas, a feature of the present invention.

Antennas AT1 to AT4 are usually mounted on a proximity fuse to radiate target detection beams B1 to B4 at four circumferential sides of a missile fuselage as shown in FIG. 4A with their beam orientation directions set at equal forward-tilt angles. The forward-tilt angle is desirably made variable so as to correspond to a relative velocity against a target. As set out above, however, such variable control is difficult to achieve.

According to the present invention, a plurality of kinds of beams' forward-tilt angles are initially prepared, beams of proper forward-tilt angles are selected in accordance with the relative velocity against the target and the missile fuselage is controlled.

Figure 4B:
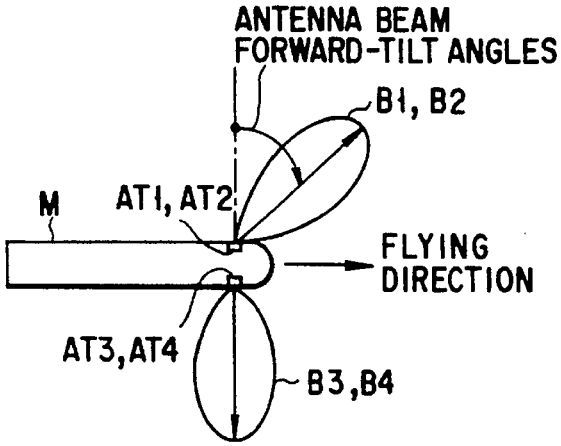
FIG. 4B is a view associated with FIG. 4A.

As shown in FIG. 4B, for example, the beam orientation directions of those mutually adjacent antennas AT1 and AT2 are forwardly tilted (forward-tilt beam) and the beam orientation directions of the other antennas AT3 and AT4 are set just alongside the fuselage (zero forward-tilt angle), that is, (vertical beams), and the relative velocity is found from the velocity information of the target and that of the missile. If the relative velocity is faster than a reference velocity, forward-tilt antennas are selected and, if the relative velocity is slower than the reference velocity, vertical beam antennas are selected. When the target is detected with the antenna beams, the missile fuselage is rolled to enable it to be detonated toward the target.

Figure 5:
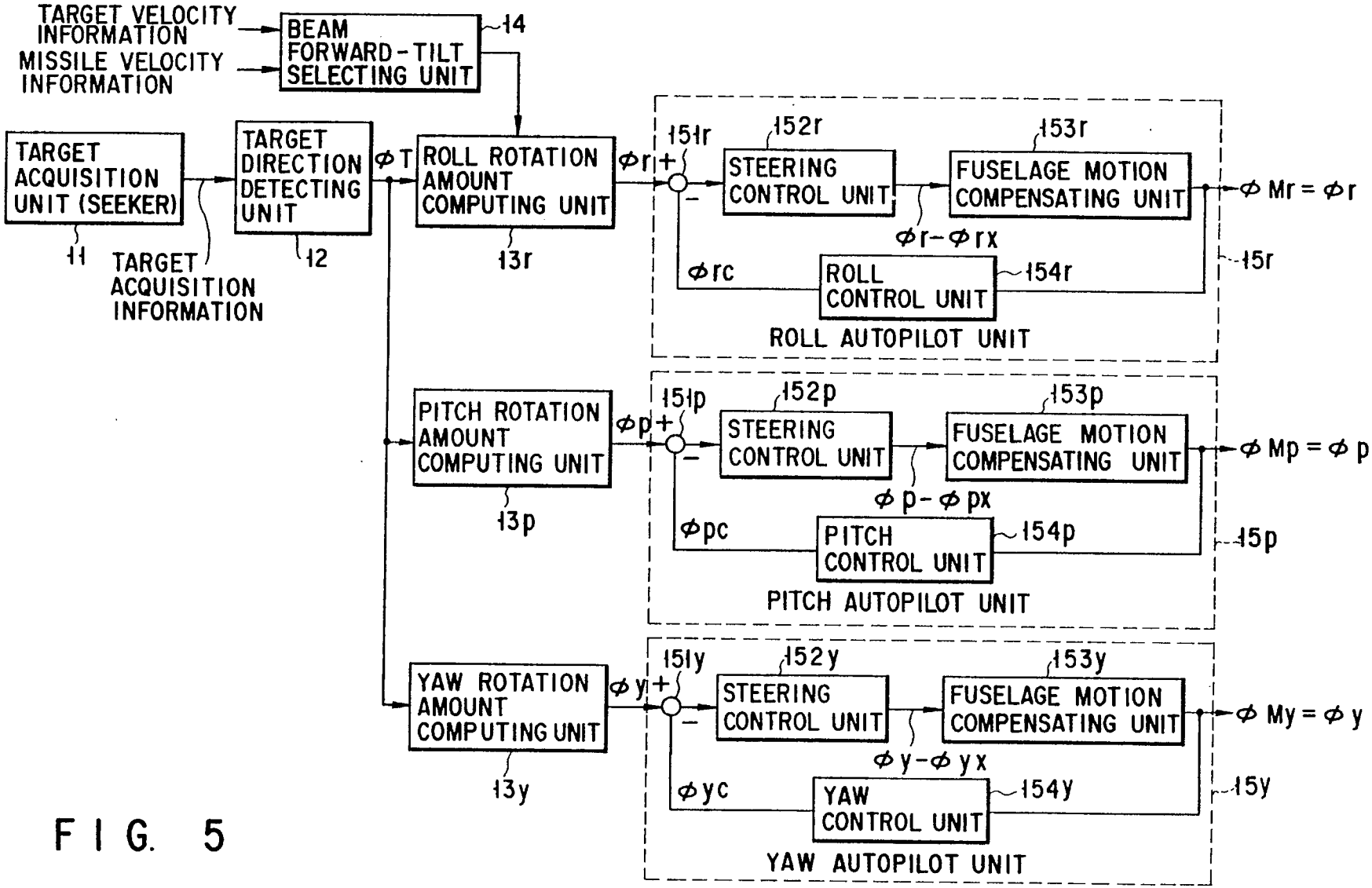
FIG. 5 is a block diagram showing an arrangement of one embodiment of the present invention.

FIG. 5 shows an arrangement of a guided missile M, as a guided missile according to the present invention, including a built-in proximity fuse having two kinds of antenna beam forward-tilt angles.

In the arrangement shown in FIG. 5, a target acquisition unit 11 acquires a target T with the use of, for example, a seeker. Target acquisition information acquired by the target acquisition unit 11 is sent to a target direction detecting unit 12. The target direction detecting unit 12 detects a target direction from the target acquisition information in terms of the respective axes of a roll r, a pitch p, and a yaw y of the fuselage. The target direction information $\phi T$ is sent to a roll rotation amount computing unit 13*r*, pitch rotation amount computing unit 13*p*, and yaw rotation amount computing unit 13*y*.

The respective rotation amount computing units 13*r*, 13*p*, and 13*y* predict a missile/target meeting point from the target direction $\phi T$ in terms of the respective axes and compute amounts of rotation around the roll, pitch, and yaw axes necessary to direct the flight direction of the missile M at that predictive meeting point. Results of computation, $\phi r$, $\phi p$, and $\phi y$ are sent to a roll autopilot unit 15*r*, pitch autopilot unit 15*p*, and yaw autopilot unit 15*y*.

The roll autopilot unit 15*r* finds a difference between a roll rotation amount $\phi 1$ received from an adder 151*r* and a roll control amount $\phi rc$ fed back from a roll control unit 154*r* to allow it to be sent to a steering computing unit 152*r* to find an amount of steering corresponding to a roll rotation amount $\phi r-\phi rx$. The steering amount is sent to a fuselage motion compensating unit 153*r* to compensate for an error involved in the motion of the missile fuselage. A corresponding signal is sent to the roll control unit 154*r* in the unit 15*r* so that roll control is carried out.

The pitch autopilot unit 15*p* find a difference between the pitch rotation amount $\phi p$ received at its adder 151*p* and a pitch control amount $\phi pc$ fed back from a pitch control unit 154*p* to allow it to be transferred to a steering computing unit 152*p* to find an amount of steering corresponding to a pitch rotation amount $\phi p-\phi px$. The amount of steering is sent to a fuselage motion compensating unit 153*p* in the pitch autopilot unit 15*p*. The unit 153*p* compensates for an error involved in the motion of the missile fuselage and sends it to the pitch control unit 154*p* for the pitch control to be carried out.

The yaw autopilot unit 15*y* finds a difference between the yaw rotation amount $\phi y$ received from an adder 151*y* and a yaw control amount $\phi yc$ fed back from a yaw control unit 154*y* to allow it to be sent to a steering computing unit 152*y* to find an amount of steering corresponding to a yaw rotation amount $\phi y-\phi yx$. The amount of steering is fed to a fuselage motion compensating unit 153*y* in the unit 15*y* to compensate for an error involved in the motion of the missile fuselage. A corresponding signal is sent to the yaw control unit 154*y* so that pitch control is performed.

Under the steering control of the autopilot units 15*r*, 15*p*, and 15*y*, the missile fuselage is directed at a predictive fuselage/target meeting point.

The features of the present invention are as will be set out below. That is, the beam forward-tilt angle selecting unit 14 receives target velocity information and missile velocity information from, for example, a ground launching equipment, not shown, finds a relative velocity from both the information, compares it with a reference velocity and, based on the result of comparison, selects any one of two kinds of beam forward-tilt angles A and B. The selected information is sent to the roll rotation amount computing unit 15*r*. The roll rotation amount computing unit 13*r* is provided initially with a computation processing program corresponding to the two kinds of antenna beams forward tilt angles A and B and selectively executes the computation processing program in accordance with selected information from the forward-tilt angle selecting unit 14.

The operation of the embodiment will be explained below with reference to FIGS. 6A to 6C.

Figure 6A:
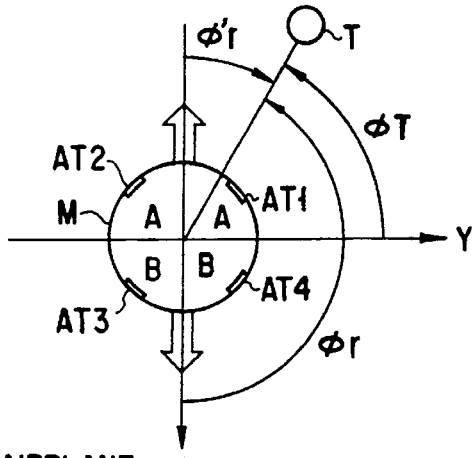
FIG. 6A is a concept diagram for explaining a control operation of the embodiment.
Figure 6B:
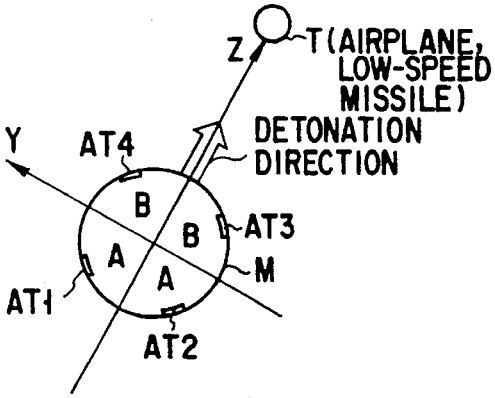
FIG. 6B is a view similar to FIG. 6A.
Figure 6C:
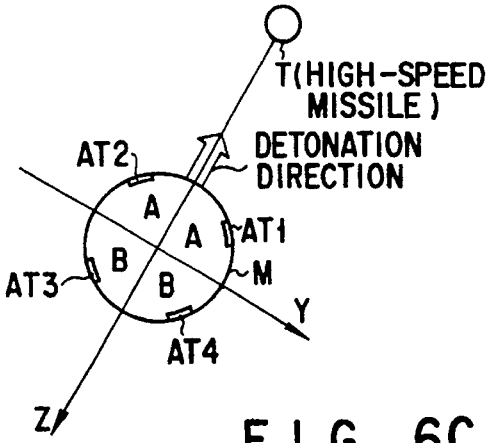
FIG. 6C is a view similar to FIG. 6A.

FIG. 6A shows a state before the missile is roll-controlled, at a target constituting an airplane and low-speed missile, FIG. 6B shows a state after the missile is roll-controlled at a target T constituting an airplane and low-speed missile, and FIG. 6C is a front view showing a state after the missile is roll-controlled at a target T constituting a high-speed missile. In these Figures, Y shows a roll reference axis of the guided missile. Antennas AT1 to AT4 at a proximal fuse in the fuselage of the missile M are arranged at angles 45°, 135°, 225° and 315° with respect to the reference axis Y. The antennas AT1 and AT2 radiate forward-tilt beams while, on the other hand, the antennas AT3 and AT4 radiate vertical beams.

Although the warhead may be non-directional around a circumferential direction, here an explanation will be given of an example of a missile having a mounted directional warhead amiable in two directions. With Z-axis vertical to the Y axis, the warhead is of such a type that the proximal fuse is detonated in a (−) direction along the Z-axis when the target T is detected with radiated beams of the antennas AT1 and AT2 and in a (+) direction along the Z-axis when the target T is detected with radiated beams of the antennas AT3 and AT4.

Let it be assumed that, in FIG. 6A, the target T constitutes an airplane and low-speed missile and its position is in a $\phi T$ direction. When the target T is acquired by the target acquisition unit 11, the angle $\phi T$ with respect to the target direction is found by the target direction detecting unit 12. From the target direction $\phi T$ the axis rotation amount computing units 13*r*, 13*p*, and 13*y* compute amounts of rotation around the roll, pitch and yaw axes of the missile fuselage necessary to direct the flight direction of the missile M at a predictive missile M/target T meeting point. Then the respective autopilot units 15*r*, 15*p*, and 15*y* effect corresponding steering control to orient the missile at the predictive missile M/target T meeting point.

On the other hand, the beam forward-tilt angle selecting unit 14 finds a relative velocity from the missile velocity information and target velocity information. Since the target T is the airplane or a low-speed airplane, the relative velocity is slower than the reference velocity and hence the roll rotation amount computing unit 13*r* is so instructed as to allow a small beam B to be selected at the beam forward-tilt angle selecting unit 14.

The so-instructed roll rotation computing unit 13*r* finds a roll angle $\phi r'$ necessary for a detonating direction to be oriented at the target direction when the target T is detected with beams formed by the antennas AT3 and AT4 Here, $\phi r=\phi T+90°$ as will be appreciated from FIG. 6A. The roll rotation amount calculated value $\phi r$ thus found is fed to the roll autopilot unit 15*r* to enable the fuselage M to be rolled by $\phi r$ as shown in FIG. 6B so that the (+) direction along the Z-axis can be directed toward the target.

Further, let it be assumed that the target T is a high-speed missile and that its position is in a direction $\phi T$ from the reference axis Y. When the target acquisition unit 12 acquires the target T, the target direction angle $\phi T$ is found by the target direction detecting unit 12. The respective axis rotation amount computing units 13*r*, 13*p*, and 13*y* compute, from the target direction $\phi T$, amounts of rotation around the roll, pitch and yaw axes necessary for the flight direction of the missile M to be directed at the predictive missile M/target T meeting point. The missile fuselage is oriented at the predictive missile M/target T meeting point.

On the other hand, the beam forward-tilt angle selecting unit 14 finds a relative velocity from the missile velocity information and target velocity information. Since the target T is a high-speed missile, the relative velocity is faster than the reference velocity and the roll rotation amount computing unit 13*r* is so instructed to allow the forward-tilt beam A to be selected at the forward-tilt selecting unit 14.

The thus instructed roll rotation amount computing unit 13*r* finds a roll angle $\phi r'$ necessary for a detonation direction to be directed at the target when the target T is detected by the antennas AT1 and AT2. Here, $\phi r'=\phi T-90°$ as will be understood from FIG. 6A. A roll rotation amount calculating value $\phi r'$ thus found is sent to the roll autopilot unit 15*r* so that the missile M is rolled by $\phi r'$ as shown in FIG. 6C to enable it to be oriented at the target.

The missile thus arranged is so designed as to have a mounted proximity fuse having a plurality of antennas having a different front tilt angle, select the antenna in accordance with the relative velocity against the target and roll its fuselage, thus offering a simple, compact fuselage structure. It is also possible to exert a warhead detonation effect on the missile target having various speed ranges.

Figure 7A:
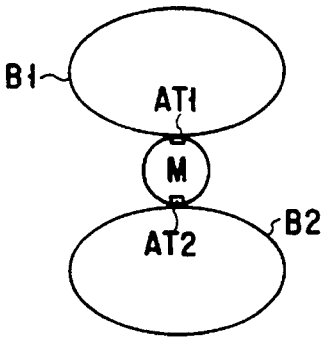
FIG. 7A shows another example of a beam pattern relative to the positions of antennas.
Figure 7B:
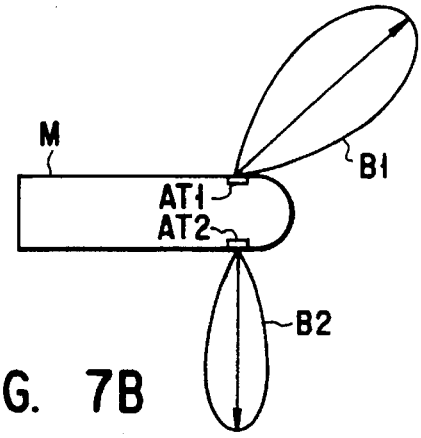
FIG. 7B is a view associated with FIG. 7A.

The present invention is not restricted to the above-mentioned embodiment. As shown, for example, in FIGS. 7A and 7B, two antennas AT1 and AT2 may be employed for the proximity fuse and the same effect can also be obtained by broadening the beam radiation range of the antennas AT1 and AT2 and orienting a shaped beam of one (AT1) of these antennas in a direction vertical to the missile fuselage M while, on the other hand, forwardly tilting a shaped beam of the other antenna AT2. In addition, it is possible to achieve a saving in the number of antennas and of transmitting/receiving units involved as well as to reduce the manufacturing costs.

Although, in the above-mentioned embodiment, one kind of forward-tilt angle is used, if mutually different forward-tilt angles are imparted to the shaped beams of the antennas AT1 to AT4 for the proximity fuse, then the guided missile of the present invention can properly explode various kind of aircraft, such as the missile, airplane and helicopter.

Figure 8:
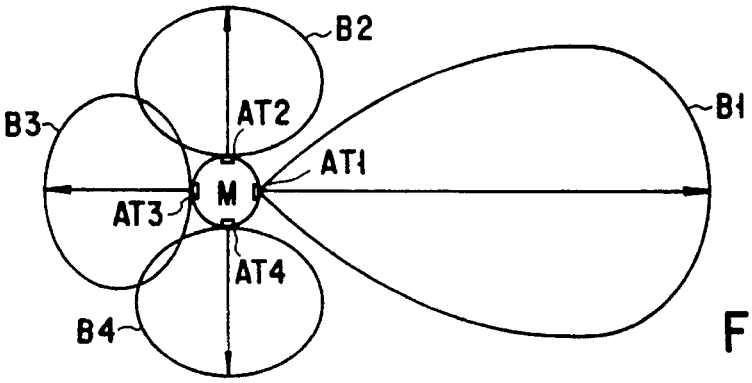
FIG. 8 is a concept diagram showing a beam power pattern relative to the positions of antennas in another embodiment of the present invention.
Figure 9:
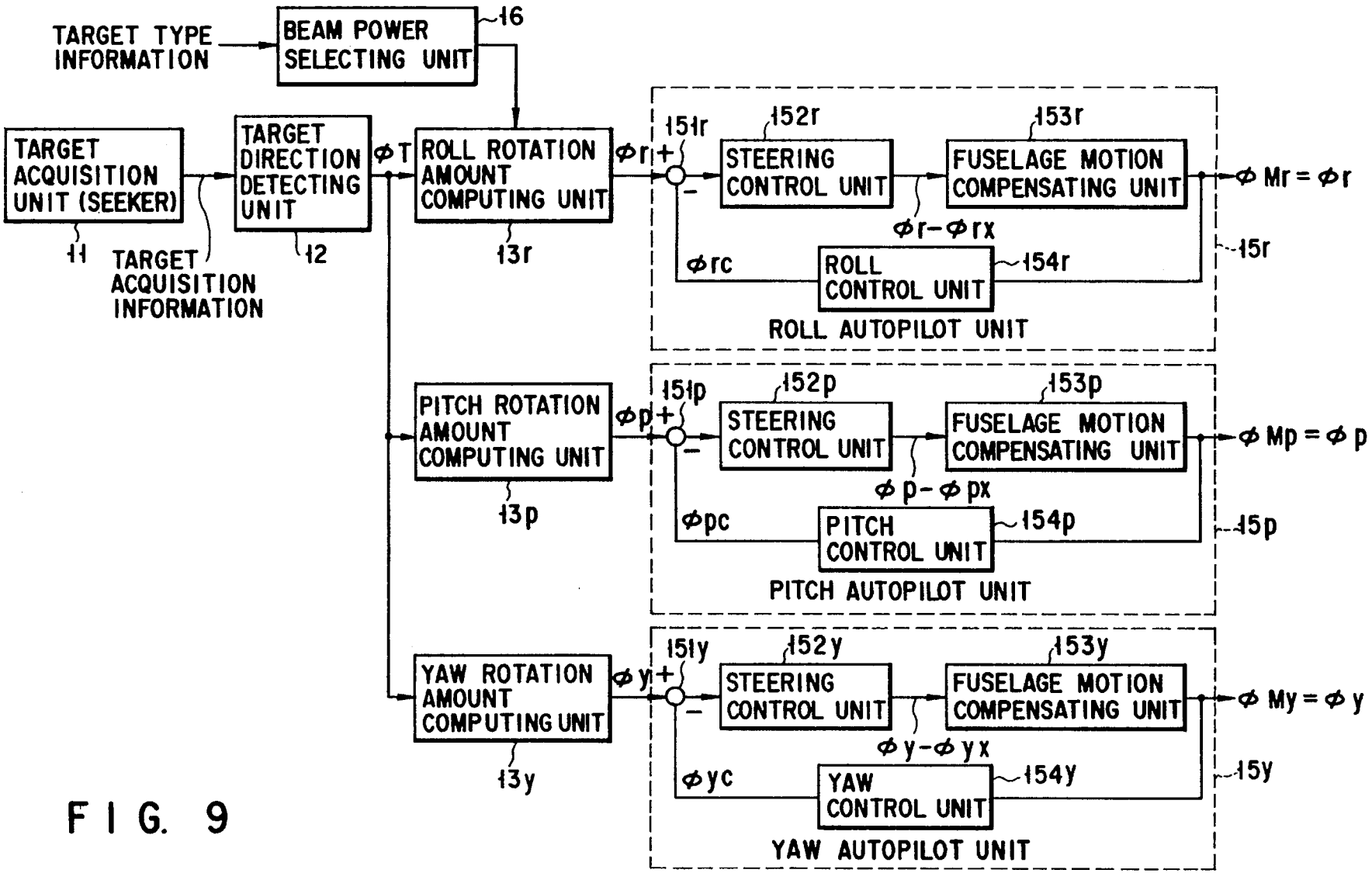
FIG. 9 is a block diagram showing an arrangement of the embodiment of FIG. 8.

It has been known that the antenna beam power may be made smaller in the case of a target of relatively large size and greater in the case of a target of small size. As shown in FIG. 8, therefore, different beam powers are set at the antennas AT1 to AT4 for the proximity fuse. As shown in FIG. 9 with the same reference numerals employed to designate parts or elements corresponding to those shown in FIG. 4, this embodiment is so designed as to select a proper beam power, at a beam power selecting unit 16, on the basis of target discriminating information, impart a result of selection to the roll rotation amount computing unit 13*r*, roll the missile fuselage to direct a corresponding beam at the target and, when the target is detected with the beam, roll the fuselage so that the missile has its detonation direction immediately oriented at the target.

As will be set out above, the missile of the present invention is so designed by the above technique as to select the antenna in accordance with the size of the target and roll the fuselage to enable it to be detonated at those targets of various sizes. It is, therefore, not necessary to create a large power beam around the whole circumference of the fuselage. Less dissipation power is required in this respect.

In the system of the present invention, it is of course possible to forwardly tilt the beam of some antenna or to reduce the number of antennas involved. In addition, the present invention can be variously changed or modified without departing from the spirit and scope of the present invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A guided missile comprising:

a target acquisition unit for acquiring a target and obtaining target information;

a target direction detecting unit for detecting, from the target information obtained at the target acquisition unit, the direction of the target in terms of a roll-, a pitch- and a yaw-axis of a missile fuselage;

rotation amount computing units for computing amounts of rotation around the roll-, pitch- and yaw-axis of the missile to allow the missile to be directed at the target detected by the target direction detecting unit;

steering control units for imparting the rotation amount around the roll-, pitch- and yaw-axis of the missile obtained by the rotation amount computing unit to the missile fuselage;

a plurality of antennas for a proximity fuse which are arranged at a corresponding number of places around a circumferential surface side of the fuselage and radiating target detection beams in mutually different directions with at least one of these antennas radiating a beam at a different forward-tilt angle other than the remaining ones;

a beam selecting unit for obtaining the flight information of the missile and target and selecting a beam of a proper angle on the basis of a result of obtained flight information; and roll rotation amount compensating means for orientating the beam which is selected by the beam selecting unit at the target.

2. The guided missile according to claim 1, wherein the beam selecting unit receives target velocity information and missile velocity information as the flight information of the target and missile to find a relative velocity of both and selects a corresponding beam on the relative velocity.

3. The guide missile according to claim 1, wherein, out of the plurality of antennas, some have mutually different forward-tilt angles and radiate target detection beams.

4. A guided missile including a target acquisition unit for acquiring a target and obtaining target information, a target direction detecting unit for detecting, from the target information obtained at the target acquisition unit, the direction of the target in terms of a roll-, a pitch- and a yaw-axis of a missile fuselage, rotation amount computing units for computing amounts of rotation around the roll-, pitch- and yaw-axis of the missile to allow the missile to be directed at the target detected by the target direction detecting unit and steering control units for imparting the rotation amount around the roll-, pitch- and yaw-axis of the missile obtained by the rotation amount computing unit to the missile fuselage, the guided missile comprising:

a plurality of antennas for a proximity fuse which are arranged at a corresponding number of places around a circumferential surface side of the fuselage and radiating target detection beams in mutually different directions with at least one of these antennas radiating a beam whose power is different from that or those of the remaining antenna or antennas;

a beam selecting unit for obtaining information representing a size of the target and selecting a beam of a proper power on the basis of a result of the obtained information; and roll rotation amount compensating means for orienting the beam selected by the beam selecting unit at the target.

5. The guided missile according to claim 4, wherein, out of the plurality of antennas, some radiate target detection beams whose powers are mutually different.

* * * * *